US007980090B2

(12) United States Patent
Lanzani

(10) Patent No.: US 7,980,090 B2
(45) Date of Patent: Jul. 19, 2011

(54) MACHINE FOR PRODUCING ICE

(75) Inventor: Emanuele Lanzani, Milan (IT)

(73) Assignee: Scotsman Group LLC, Vernon Hills, IL (US)

( * ) Notice: Subject to any disclaimer, the term of this patent is extended or adjusted under 35 U.S.C. 154(b) by 72 days.

(21) Appl. No.: 12/223,240

(22) PCT Filed: Jan. 25, 2007

(86) PCT No.: PCT/EP2007/000637

§ 371 (c)(1),
(2), (4) Date: Jul. 28, 2009

(87) PCT Pub. No.: WO2007/090523

PCT Pub. Date: Aug. 16, 2007

(65) Prior Publication Data

US 2010/0180622 A1 Jul. 22, 2010

(30) Foreign Application Priority Data

Feb. 10, 2006 (IT) ..... MI2006A0250

(51) Int. Cl.
*F25C 1/14* (2006.01)

(52) U.S. Cl. ..... 62/354; 62/381

(58) Field of Classification Search ..... 62/320, 62/354, 340, 381
See application file for complete search history.

(56) References Cited

U.S. PATENT DOCUMENTS

| | | | | | |
|---|---|---|---|---|---|
| 3,501,927 | A | | 3/1970 | Wadsack | 62/320 |
| 3,704,599 | A | * | 12/1972 | Darby et al. | 62/354 |
| 3,769,809 | A | * | 11/1973 | Robinson et al. | 62/137 |
| 4,198,831 | A | * | 4/1980 | Barnard et al. | 62/320 |
| 4,328,681 | A | * | 5/1982 | Sakamoto et al. | 62/157 |
| 4,497,184 | A | * | 2/1985 | Utter et al. | 62/354 |
| 4,969,337 | A | * | 11/1990 | Hida | 62/320 |
| 5,501,081 | A | * | 3/1996 | Mori et al. | 62/135 |
| 5,533,464 | A | * | 7/1996 | Todd | 116/174 |
| 6,952,935 | B2 | * | 10/2005 | Vorosmarti et al. | 62/344 |
| 7,003,974 | B1 | * | 2/2006 | Brooks | 62/320 |
| 7,469,552 | B2 | * | 12/2008 | Brunner et al. | 62/320 |
| 2005/0103039 | A1 | | 5/2005 | Vorosmarti | 62/344 |

FOREIGN PATENT DOCUMENTS

CN 2453355 10/2001

OTHER PUBLICATIONS

Notification of the First Office Action dated Sep. 25, 2009 issued by the Patent Office of the People's Republic of China in the corresponding Chinese Patent Application No. 200780004725.6.

* cited by examiner

*Primary Examiner* — Mohammad Ali
(74) *Attorney, Agent, or Firm* — Ohlandt, Greeley, Ruggiero & Perle, LLP

(57) ABSTRACT

The machine for the production of ice, comprises a tubular pipe to form the ice, covered by a refrigerator group evaporator, and having an auger inside to move the ice towards the delivery outlet, associated with a ring nut having a plurality of drawing holes arranged angularly spaced along a circumference, the delivery outlet of the tubular pipe is associated with the terminal inlet of the conveyor of ice, having a substantially upward axial extension and a terminal outlet part positioned at a level substantially higher than the top of the machine.

26 Claims, 4 Drawing Sheets

MACHINE FOR PRODUCING ICE

The present invention relates to a machine for producing ice.

Machines for ice production have existed on the market for some time, of the type comprising a tubular pipe for forming the ice, covered by a refrigerator group evaporator, and equipped with an auger at its interior that transfers the ice to the delivery outlet, to which a ring nut pierced with drawing holes is associated.

In particular, the machines referred to herein are conceived to produce ice in small pieces, so-called "nuggets" or "flakers", or in granule or cube form.

One of the main problems that exists with these machines involves positioning the machine in an area that is easily accessible making the ice readily available for the user, without the machine installation position being inconvenient.

Generally this type of machine is equipped with an external ice dispenser on one of its sides, and the machine itself is set directly on the floor.

In this case, the user is forced to bend down to reach the ice that accumulates in a container at ground level, where polluting and contaminating agents tend to concentrate, together with any dust in the atmosphere.

For this reason, often the machines are raised to a higher level from the ground for easier access and better hygiene, and the external ice dispenser is positioned on the side or bottom of the machine.

In this case, the advantage of improved hygiene, and easy access to the ice at standing height, is compromised by the fact that the position of the machine often obstructs transit, and complicated systems must be created to support the machine, which must foresee suitable support brackets and safety locking systems which are not necessary when the machine is simply positioned on the ground.

When the machine is placed in a raised position, not all parts are easily accessed by the user.

The technical task of the present invention therefore, is to create a machine for ice production that will resolve the technical problems described in prior art.

In the context of this technical task, one object of the invention is to create a machine for ice production which has a supply position with comfortable user access to the ice dispenser while making all machine parts easily accessible for inspection, maintenance, assembly, disassembly and cleaning, at the same time.

Another object of the invention is to make a machine for ice production that permits positioning the ice dispenser at standing height without complicating the machine structure and/or requiring a specific support structure in a raised position from the ground.

Another object of the invention is to make a machine for ice production that can dispense the ice into a tank in a position that is protected from pollutants and/or dust present in the environment where the machine is installed.

By no means the last object of the invention is to provide a machine for ice production that is simple and economical to construct.

The technical task as well as these and other objects according to the present invention is achieved with the creation of a machine for ice production, of the type comprising a tubular pipe to form the ice, covered by a refrigerator group evaporator, and equipped with an auger that transfers the ice to the delivery outlet to which a ring nut pierced with drawing holes is associated, drawing holes arranged angularly spaced along the circumference, characterised in that said delivery outlet of said tubular pipe is associated with the end of the inlet of conveying means of said ice, having a substantially upward axial extension and the end of the outlet positioned at a level substantially higher than the top of said machine.

Other characteristics of the present invention are moreover defined in the following claims.

Further characteristics and advantages of the invention will be made more apparent from the description of a preferred, but by no means exclusive embodiment of the machine for ice production according to the invention, illustrated as an example, but not to be considered limiting, in the attached drawings, wherein.

Figure 1:
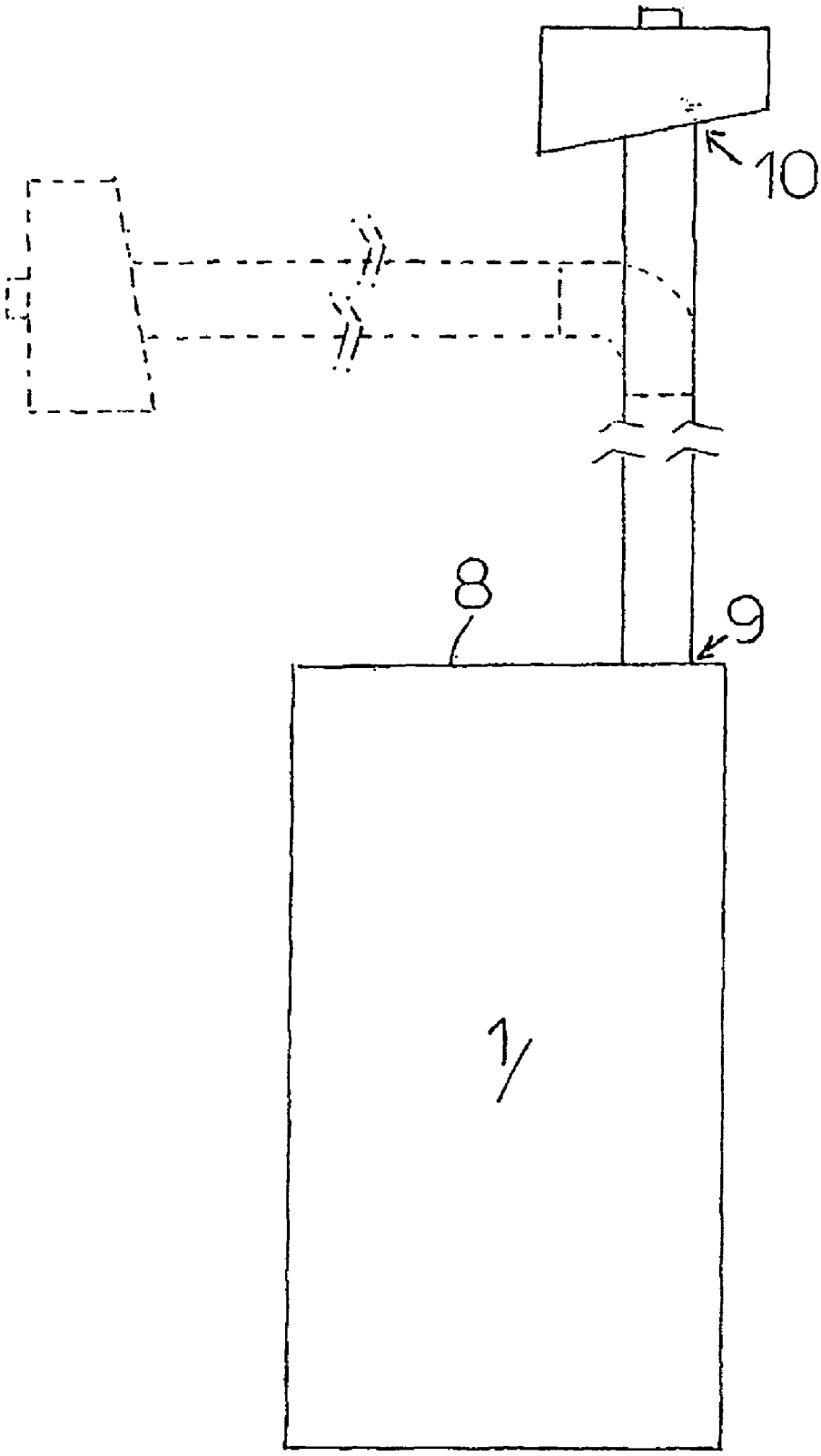
FIG. 1 shows a schematic view of a machine in accordance with the invention, wherein a first and a second preferred alternative modes for creating a means for externally conveying the ice, are shown by continuous and dashed lines, respectively.
Figure 2:
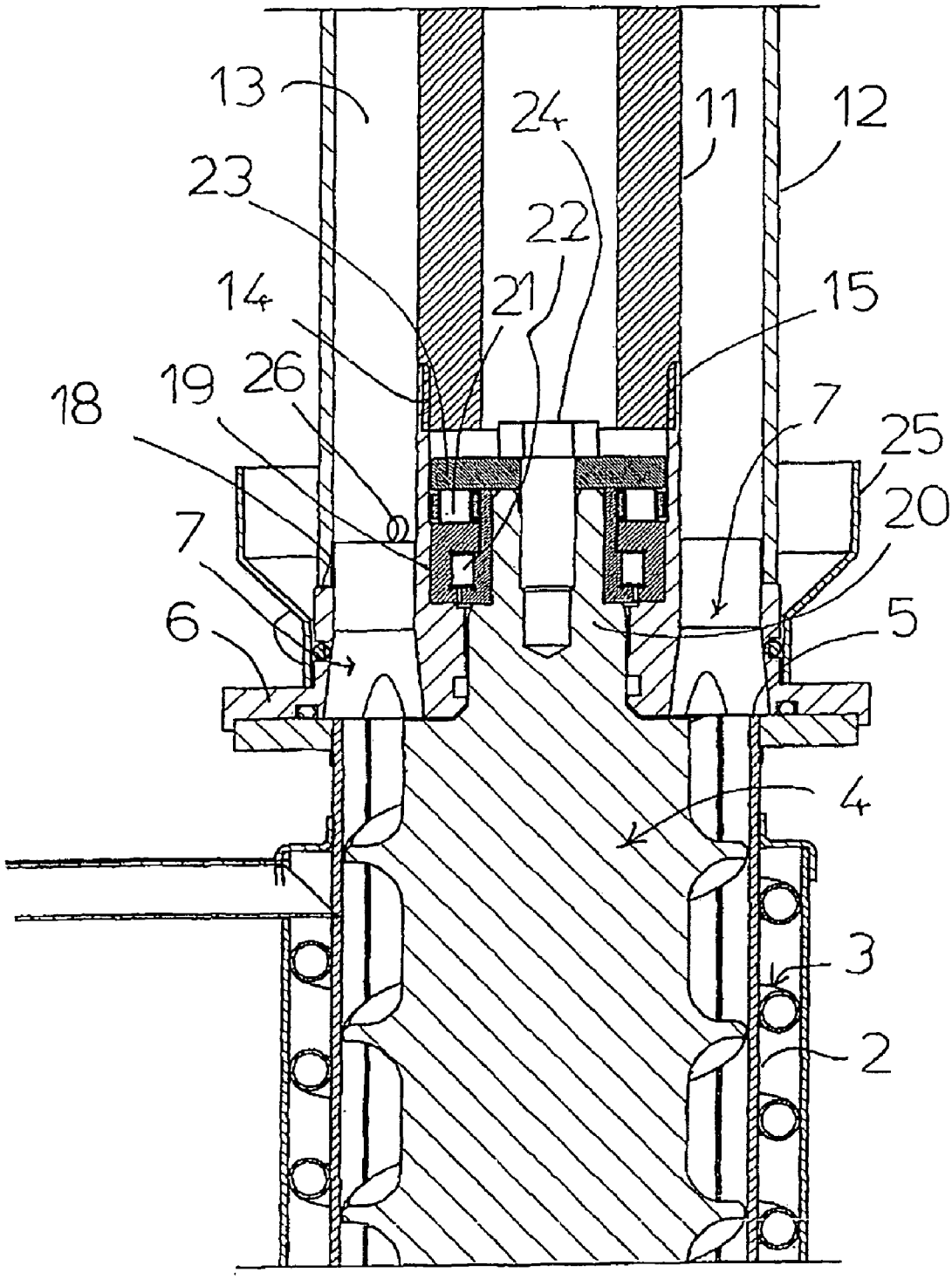
FIG. 2 shows an enlarged axial cross section of a detail of the machine in FIG. 1 at the point where the conveyor means is connected to the machine.
Figure 3:
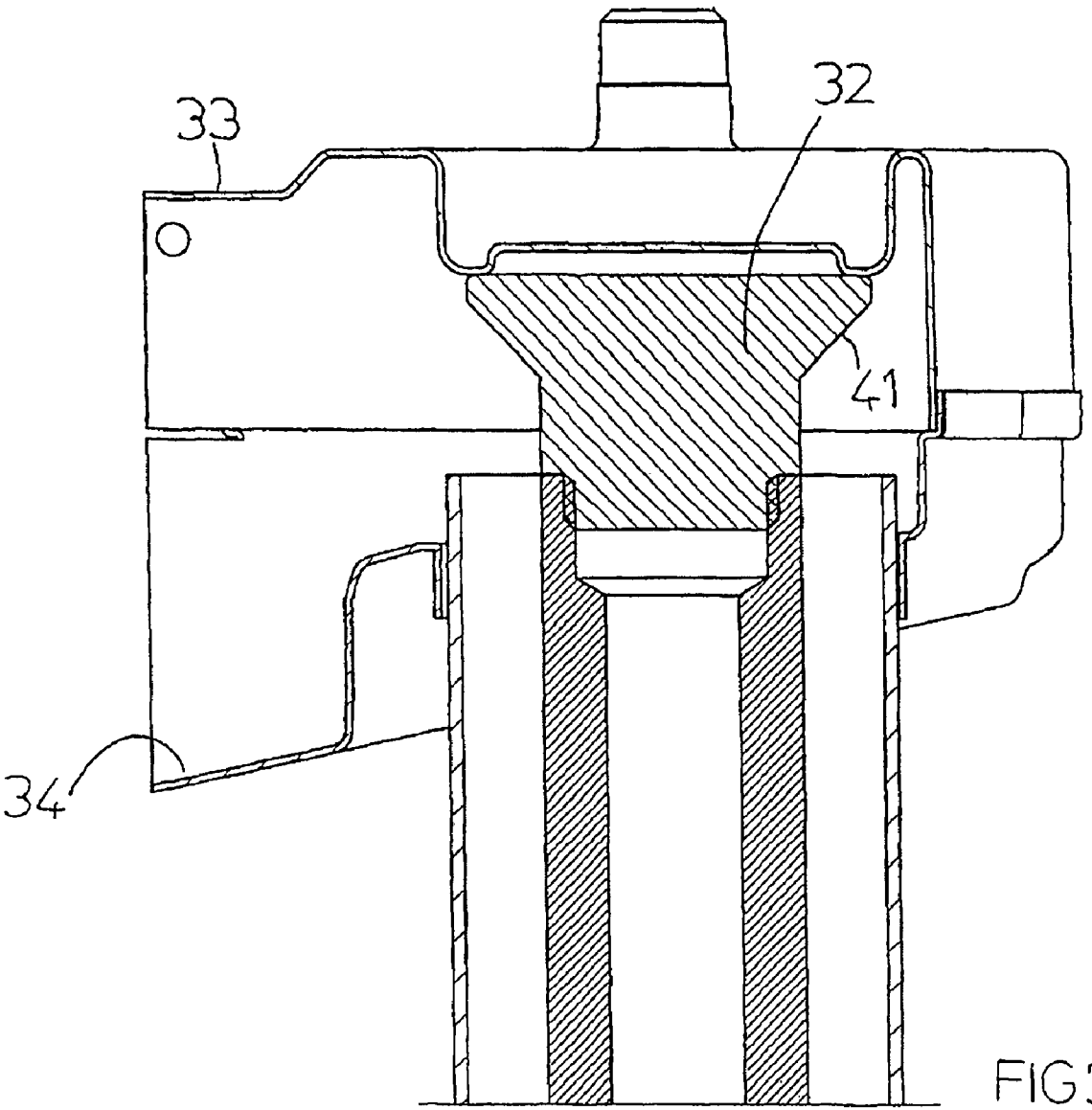
FIG. 3 shows an enlarged axial cross section of a detail of the terminal outlet end of the conveying means.
Figure 4:
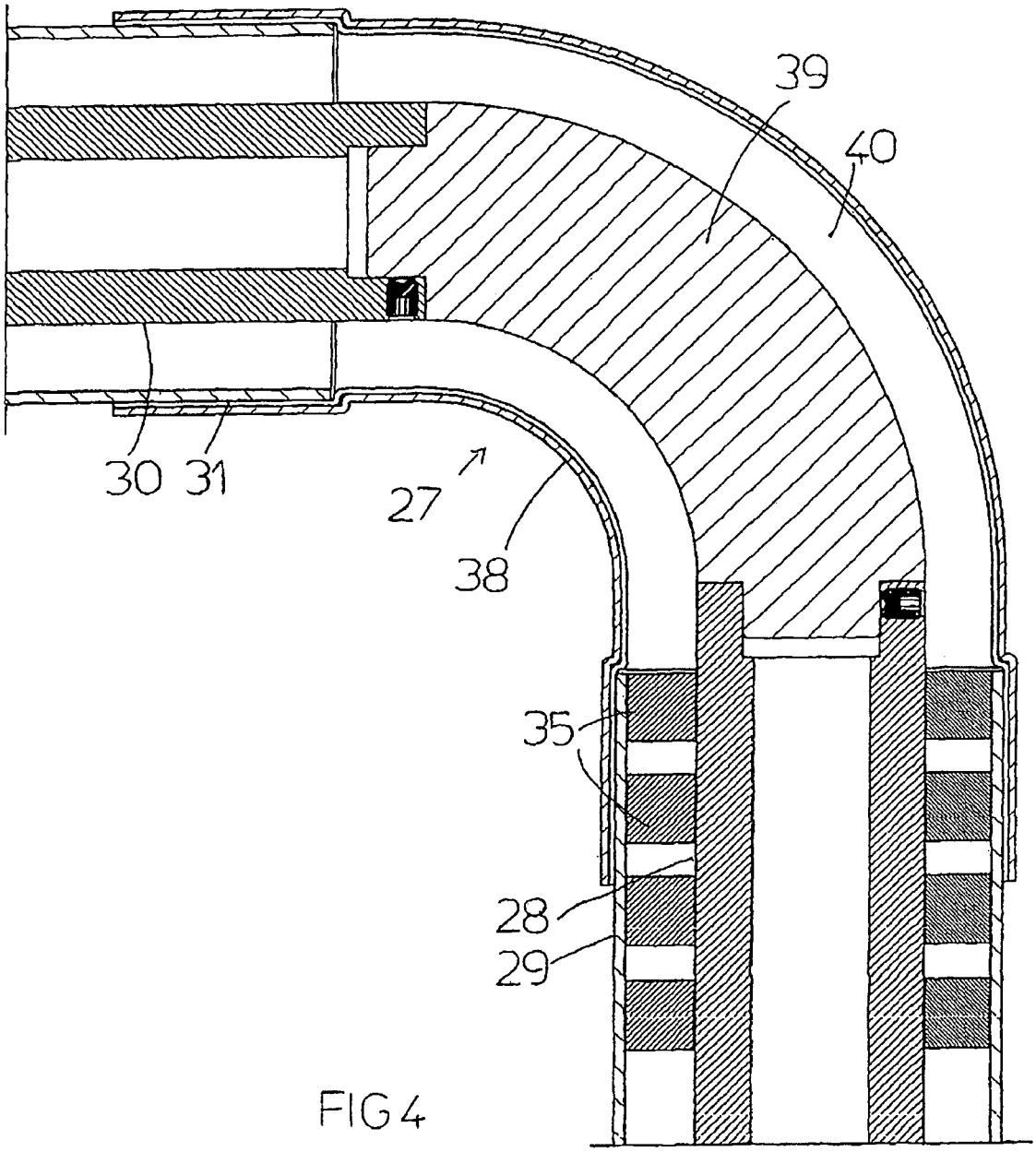
FIG. 4 shows an enlarged axial cross section of a detail of the elbow joint between the vertical section and the horizontal section of the conveyor means in accordance with the second preferred embodiment mode.

In the aforesaid figures, the machine for ice production is identified throughout by the numeral 1.

The machine 1 is destined in particular for the production of "nuggets", in other words, small cylindrically shaped pieces of ice of the desired diameter.

The machine 1 comprises a tubular pipe 2 to form the ice, covered by an evaporator 3 of a refrigerator group not illustrated), and containing an auger 4 to convey the ice towards the delivery outlet 5 to which a ring nut 6 is associated, having a plurality of drawing holes 7 arranged angularly spaced along a circumference.

The ring nut 6 comprises a central sleeve 19 in which the head hub 20 is positioned of the auger 4 shaft, and supported in a fixed position by means of rotation bearings 21 and 22 interposed between the internal side surface of the central sleeve 19 of the ring nut 6 and the side surface of the head hub 20 of the auger 4 shaft.

In particular the bearings 21 and 22, respectively, are rollers with a parallel rotation axis and orthogonal, respectively, to the axis of the auger 4.

A ring 23 is attached by means of at least one screw 24 to the head hub 20 of the auger 4 shaft to maintain the rotation bearings 21 and 22 in position.

Advantageously, the delivery outlet 5 of the tubular pipe 2 is open at the top 8 of machine 1

In particular, the tubular pipe 2 and auger 4 positioned inside the pipe have a vertical axis.

Alternatively it is also possible to position the auger 4 in a different direction and ensure that the delivery of the ice-forming tubular pipe is positioned on the side of the machine.

The terminal part of the delivery 5 of the tubular pipe 2 is associated with the terminal part of the inlet 9 of suitable conveying means for the ice, with an axial extension in a substantially upward direction.

The terminal part of the outlet 10 of the conveyor means is positioned at a level that is substantially higher than the top 8 of machine 1.

More precisely, the conveyor means comprise a first longitudinal element 11 and a second longitudinal element 12 having at least one terminal section that is coaxial with the tubular pipe 2, in particular, the terminal section adjacent to the tubular pipe 2.

At least the second longitudinal element 12, and preferably also the first longitudinal element 11 are tubular with cross-sections that are preferably but not necessarily circular.

The first tubular element 11 is positioned inside the second tubular element 12 with which it delimits an annular interspace 13 facing the drawing holes 7, in which the small ice pieces 35 pass.

The radial extension of the annular interspace 13 is not less than the diameter of the outlet cross-section of the extrusion drawing holes 7.

As illustrated, preferably the radial extension of the annular interspace 13, i.e. the distance between the external side surface of the first tubular element 11 and the internal side surface of the second tubular element 12, is substantially equal, or rather in practice very slightly larger, than the diameter of the outlet cross-section of the drawing holes 7.

The drawing holes 7 taper progressively from their inlet cross-section towards their outlet cross-section, until the desired value is attained.

In particular, the cross-section of the drawing holes 7 remains constant in the outlet zone and tapers conically in the inlet zone superimposed on the annular interspace present between the tubular pipe 2 and the auger 4.

The machine 1 has a first and a respectively second connection means between the ring nut 6 and the first and second tubular elements 11 and 12, respectively.

The first connection elements comprise an annular recess 14 on the external side surface of the first tubular element 11 on which an extension 15 is fitted of the central sleeve 19 of ring nut 6.

The external side surface of the extension 15 is substantially set on the extension of the external side surface of the first tubular element 11 so that it does not create a discontinuous surface in the ice sliding path.

In particular, the extension 15 has an internal thread for coupling with an external counter-thread of the first tubular element 11.

The second connection elements comprise an annular shoulder 18 of the ring nut 6 to support the second tubular element 12.

The internal side surface of the shoulder 18 is substantially set on the extension of the internal side surface of the second tubular element 12, once again in order to ensure there is no discontinuous surface in the ice sliding path.

The junction area between the ring nut 6 and the conveyor means is externally encircled by a collector element 25 of condensation water or melted ice.

At the base of the second external pipe 12 there is also at least one hole 26 to drain said water towards the collector element 25.

According to an advantageous aspect of the invention, since the ice produced in the machine must travel along a course which may even be of a considerable length according to requirements, instead of the usual single screw, the auger has a double screw to ensure a sufficiently strong mechanical thrust.

In a first preferred embodiment, the first and second tubular elements 11 and 12 are straight and positioned vertically.

In a second preferred embodiment, shown with dashed lines, the first and second tubular elements 11 and 12 have at least one, preferably right-angle elbow joint 27 which unites an upstream vertical section 28, 29 with a downstream horizontal section 30, 31.

The elbow joint 27 has an external tubular shell 38 and a core 39 which form an annular interspace 40 identical to the existing annular interspace between the first and second tubular elements 11 and 12.

The terminal outlet part of the first tubular element 11 has an ice crusher element 32, having in particular a deflecting surface 41 which is tilted with respect to the axis of the first tubular element 11.

On the other hand, the terminal outlet part of the second tubular element 12 bears a crushed ice dispenser 33, having a tilted bottom 34 to facilitate the sliding of the crushed ice towards the exterior when the second tubular element 12 or a terminal section thereof is in a vertical position.

In another solution, not illustrated, the dispenser 33 has one or more supply channels which are angularly spaced around the second tubular element 12.

Moreover, the second tubular element 12 has external insulation coating (not shown) to prevent the ice from melting.

Preferably, the second tubular element 12 is made from a transparent material, and the insulation coating has at least one window opening to permit inspection of the interior of the second tubular element 12.

The present invention permits positioning the ice dispenser with extreme versatility in the chosen location without having to raise the machine off the ground.

In this manner, the machine can be positioned where it does not create obstruction, and so it is accessible for inspection or other operations, while the ice dispenser is placed in a position at a distance which is handy for the user, and suitable for ensuring the hygiene of the stored ice.

The connection of the conveyor means onto the ring out 6 is moveover extremely simple and can be performed rapidly.

The machine for ice production conceived in this manner can be subject to numerous variations and modifications, all of which remain within the scope of the inventive concept; furthermore, all details can be replaced by technically equivalent elements.

Practically speaking, all materials employed, as well as the size of the elements can be of any type according to necessity and the state of the art.

The invention claimed is:

1. A machine for the production of ice, comprising a tubular pipe to form the ice, covered by a refrigerator evaporator, and having an auger inside to move the ice towards the delivery outlet, associated with a ring nut having a plurality of drawing holes arranged angularly spaced along a circumference, wherein said delivery outlet of said tubular pipe above said drawing holes is associated with a terminal inlet part of a conveyor of said ice, having a substantially upward axial extension and a terminal outlet part positioned at a level substantially higher than said top of said machine, wherein said conveyor comprises a first and a second longitudinal element having at least one terminal section coaxial with said tubular pipe, and a crushing element for said ice is present at an outlet end of said first longitudinal element.

2. A machine for the production of ice according to claim 1, wherein said delivery outlet of said tubular pipe opens at the top of said machine.

3. A machine for the production of ice according to claim 1, wherein at least said second longitudinal element is tubular.

4. A machine for the production of ice according to claim 1, wherein at least said first longitudinal element is tubular.

5. A machine for the production of ice according to claim 1, wherein said first longitudinal element is inside said second longitudinal tubular element with which it delimits an annular interspace facing said drawing holes.

6. A machine for the production of ice according to claim 5, wherein the radial extension of said annular interspace is not less than the diameter of the outlet cross-section of said drawing holes.

7. A machine for the production of ice according to claim 5, wherein the radial extension of said annular interspace is substantially equal to the diameter of the outlet cross-section of said drawing holes.

8. A machine for the production of ice according to claim 1, wherein said drawing holes taper progressively from their inlet cross-section to their outlet cross-section.

9. The machine for the production of ice according to claim 1, wherein said auger has a double screw.

10. The machine for the production of ice according to claim 1, wherein said first and second longitudinal elements are rectilinear.

11. The machine for the production of ice according to claim 1, wherein said first and second longitudinal elements are vertical.

12. The machine for the production of ice according to claim 1, wherein said first and second longitudinal elements present at least one angle.

13. The machine for the production of ice according to claim 12, wherein said angle is a right angle.

14. The machine for the production of ice according to claim 1, wherein said first and second longitudinal elements have a vertical section and a horizontal section.

15. The machine for the production of ice according to claim 1, wherein said crushing element has a deflecting surface which is tilted with respect to the axis of said first longitudinal element.

16. A machine for the production of ice, comprising a tubular pipe to form the ice, covered by a refrigerator evaporator, and having an auger inside to move the ice towards the delivery outlet, associated with a ring nut having a plurality of drawing holes arranged angularly spaced along a circumference, wherein said delivery outlet of said tubular pipe is associated with the terminal inlet part of a conveyor of said ice, having a substantially upward axial extension and a terminal outlet part positioned at a level substantially higher than said top of said machine, wherein said conveyor comprises a first and a second longitudinal element having at least one terminal section coaxial with said tubular pipe, and first and second connectors, respectively, between said ring nut and said respective first and second longitudinal elements.

17. The machine for the production of ice according to claim 16, wherein said first connector comprise an annular recess of the external side surface of said first longitudinal element, on which an extension is fitted of a central sleeve of said ring nut.

18. The machine for the production of ice according to claim 17, wherein said external side surface of said extension is substantially on the external side surface of said first longitudinal element.

19. The machine for the production of ice according to claim 18, wherein said extension has an internal thread for its coupling with an external counter-thread of said first internal tubular element.

20. The machine for the production of ice according to claim 16, wherein said second connector comprise an annular shoulder of said ring nut on which a second tubular element is supported.

21. The machine for the production of ice according to claim 20, wherein a side surface of said shoulder is substantially on the extension of the internal side surface of said second tubular element.

22. The machine for the production of ice according to claim 20, wherein the outlet end of said second tubular element bears a dispenser of said crushed ice, having a tilted bottom with respect to the axis of said second longitudinal element for sliding said crushed ice towards the exterior.

23. The machine for the production of ice according to claim 22, wherein said dispenser has one or more supply channels which are angularly spaced around the outlet end of said second tubular element.

24. The machine for the production of ice according to claim 20, wherein said second tubular element has an external insulation coating.

25. The machine for the production of ice according to claim 20, wherein said second tubular element is made of a transparent material, and that said insulation coating has at least one inspection window to view the interior of said second tubular element.

26. A machine for the production of ice comprising a tubular pipe to form the ice, covered by a refrigerator evaporator, and having an auger inside to move the ice towards the delivery outlet, associated with a ring nut having a plurality of drawing holes arranged angularly spaced along a circumference, wherein said delivery outlet of said tubular pipe is associated with the terminal inlet part of a conveyor of said ice, having a substantially upward axial extension and a terminal outlet part positioned at a level substantially higher than said top of said machine, and wherein a junction area between said ring nut and said conveyor is externally encircled by a collector of condensation water or water melted from said ice, drained from at least one drainage hole present on said external pipe.

* * * * *